US005752366A

United States Patent [19]

Wilfong et al.

[11] Patent Number: 5,752,366

[45] Date of Patent: May 19, 1998

[54] AUTOMATIC PLACER WITH VELOCITY COMPONENT DAMPENING

[75] Inventors: Matt D. Wilfong; Peter V. Doll, both of Madison, Wis.; Gregory J. Risse, Athens, Ga.

[73] Assignee: Kraft Foods, Inc., Northfield, Ill.

[21] Appl. No.: 847,250

[22] Filed: May 1, 1997

[51] Int. Cl.[6] ..... B65B 35/50

[52] U.S. Cl. ..... 53/447; 53/540; 53/246; 53/250; 53/254; 53/473; 53/532; 53/539

[58] Field of Search ..... 53/447, 473, 475, 53/246, 247, 250, 254, 532, 539, 540

[56] References Cited

U.S. PATENT DOCUMENTS

| | | | |
|---|---|---|---|
| 2,553,683 | 5/1951 | Smith . | |
| 3,347,016 | 10/1967 | Silverman | 53/254 X |
| 3,604,181 | 9/1971 | Adcox . | |
| 3,678,650 | 7/1972 | Green, Jr. . | |
| 3,786,617 | 1/1974 | Fluck . | |
| 3,791,099 | 2/1974 | Wagner | 53/243 X |
| 3,812,647 | 5/1974 | Bertling et al. | 53/540 X |
| 3,927,508 | 12/1975 | Campbell | 53/251 |
| 3,990,209 | 11/1976 | Eisenberg . | |
| 4,013,179 | 3/1977 | Fluck . | |
| 4,056,919 | 11/1977 | Hirsch . | |
| 4,159,761 | 7/1979 | Egee et al. . | |
| 4,217,745 | 8/1980 | Watzka . | |
| 4,226,073 | 10/1980 | Rose et al. | 53/532 |
| 4,398,383 | 8/1983 | Prakken . | |
| 4,416,103 | 11/1983 | Ewer et al. . | |
| 4,478,024 | 10/1984 | Vedvik et al. . | |
| 4,546,594 | 10/1985 | Mohaupt . | |
| 4,608,808 | 9/1986 | Ryan et al. . | |
| 4,709,535 | 12/1987 | Mahaffy et al. . | |
| 4,882,895 | 11/1989 | Hsieh et al. . | |
| 4,955,794 | 9/1990 | Fluck | 53/532 X |
| 5,018,338 | 5/1991 | Jurchuk et al. | 53/532 |
| 5,069,019 | 12/1991 | Lodewegen | 53/447 X |
| 5,095,684 | 3/1992 | Walker et al. . | |
| 5,159,796 | 11/1992 | Tas . | |
| 5,279,096 | 1/1994 | Mims | 53/540 X |
| 5,329,749 | 7/1994 | Yamamoto et al. . | |
| 5,398,479 | 3/1995 | Diete et al. | 53/540 X |

*Primary Examiner*—Daniel Moon

*Attorney, Agent, or Firm*—Lockwood, Alex, Fitzgibbon & Cummings

[57] ABSTRACT

Thin and lightweight baked products such as crackers and the like are dispensed from a stack and placed into a compartment of a packaging tray or the like. An escapement gate assembly supports the product as it falls into a accumulator opening and before it drops into the compartment of the packaging tray. This engagement need be for only a small fraction of a second, long enough to dissipate virtually all of the horizontal velocity components imparted to the products during handling of the products prior to dropping into the compartment. A preferred application moves a sub-stack of crackers from a larger stack and into the compartment.

19 Claims, 3 Drawing Sheets

AUTOMATIC PLACER WITH VELOCITY COMPONENT DAMPENING

BACKGROUND AND FIELD OF THE INVENTION

The present invention generally relates to apparatus and method for placing thin and lightweight baked products such as crackers and the like into relatively close-fitting compartments of packaging trays. More particularly, the invention relates to automatically dispensing and placing these types of products into packaging compartments which are sized and shaped so as to somewhat closely accommodate therewithin a plurality of these types of baked products. The baked products are transferred from a stack of the products and placed into a compartment of the package. Prior to placement of the products into the package compartment, the device and method absorb or dampen the horizontal component of the velocity developed in the products during the transfer operation.

Equipment and procedures have been heretofore known for transferring disc-shaped and similar generally flat products into packaging for retail sale and the like. For example, material-handling equipment is available from Campbell-Hardage, Inc., of Athens, Ga. Equipment of this type can be configured so as to place relatively thin and lightweight baked products such as crackers into commercial packaging. When that commercial packaging is somewhat close fitting and when these types of baked products are handled, problems arise which make it difficult to accomplish placements which are fully reliable and repeatable. Consistent filling has been difficult. All too often, one or more of these types of products rest in the package in a tipped, cocked or on-edge orientation. At times, a product slides completely out of the package and is lost or left on top of the package rather than in the proper compartment. It has been observed that up to about one fifth of the packages filled in this manner have defects in that one or more of the baked products are broken, unevenly positioned within the compartment and/or missing from the compartment after transfer has been effected by this material-handling equipment. If, for example, a plurality of crackers are to be packaged within a retail packaging tray, previously known equipment does not allow proper placement resulting in short counts of crackers and the like because a cracker did not properly enter the package compartment during an automated filling and sealing procedure.

Other transfer mechanisms are known. For example, U.S. Pat. No. 4,416,103 shows transferring stacks of food slices from a conveyor to a package-loading station, a shuttle being used to accomplish this task. With this approach, stacks of sliced food products are temporarily supported on knife blades and/or fingers so as to prevent gravity discharge of a stack until the stack is at rest. Stops are provided to prevent slippage due to conveyor momentum. The momentum problem addressed by this type of prior art is characteristic of a stack of sliced food products such as luncheon meats, the concern being that the stacks will topple over, and the stops are instrumental in preventing this undesirable result. While the components of this patent are somewhat akin to those of the present invention, the function achieved is substantially different, and the mechanisms used are not particularly directed toward solving the problem which has been recognized by the present invention. Prior art such as this does not recognize or address the problem of absorbing kinetic energy by dampening horizontal velocity components developed during cracker transfer prior to cracker placement into the package compartment.

SUMMARY OF THE INVENTION

The present invention addresses a problem of unsatisfactory reliability and repeatability during placing of thin and lightweight baked products such as crackers and the like into a close-fitting compartment of a packaging tray. The invention recognizes that transfer problems in this context are caused in large measure by the development of kinetic energy within the crackers or the like when they are transferred from one location to the other. Also recognized by the invention is the importance of dissipating and absorbing the horizontal velocity components of this developed kinetic energy prior to attempted placement of crackers or the like into the packaging tray compartment.

With the present invention, an escapement gate mechanism includes a component which contacts recently transferred thin and lightweight baked products for an extremely short time period. This short-time contact is carried out after product transfer and shortly before product placement into the close-fitting packaging tray compartment. This engagement by a member of an escapement gate mechanism occurs while one or more of the baked products are within an accumulator opening of a guide block and immediately after baked product transfer into this accumulator opening from a transfer opening of a pusher. The baked product(s) had entered the pusher transfer opening from a stack of baked products. This transfer of baked product(s) into the guide block accumulator opening develops kinetic energy, and horizontal velocity components are dissipated and/or absorbed when the baked product(s) are engaged by the escapement gate assembly. Preferably, this engagement is effected for only a very short period of time. Thereafter, the escapement gate assembly opens, and each baked product in the accumulator opening falls into the close-fitting compartment in an ordered and controlled manner.

It accordingly a general object of the present invention to provide an improved automatic placer and placement method which absorbs disruptive horizontal velocity components of the items being placed.

Another object of the present invention is to provide an improved apparatus and method for placing thin and lightweight baked products such as crackers and the like from a stack of such products and into a close-fitting compartment of a packaging tray.

Another object of the present invention is to provide an improved product transfer and placement apparatus and method which raise the reliability and repeatability of the placement operation to virtually perfect levels.

Another object of this invention is to provide an improved apparatus and method which improves product quality of packaged goods having thin and lightweight baked products stacked and sealed therewithin, particularly by eliminating short counts of such baked products caused by erratic placement.

Another object of this invention is to provide an extremely accurate placement of a stack of multiple crackers within a compartment of a tray, which compartment has a size and shape which very closely accommodates the cracker stack.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 1:
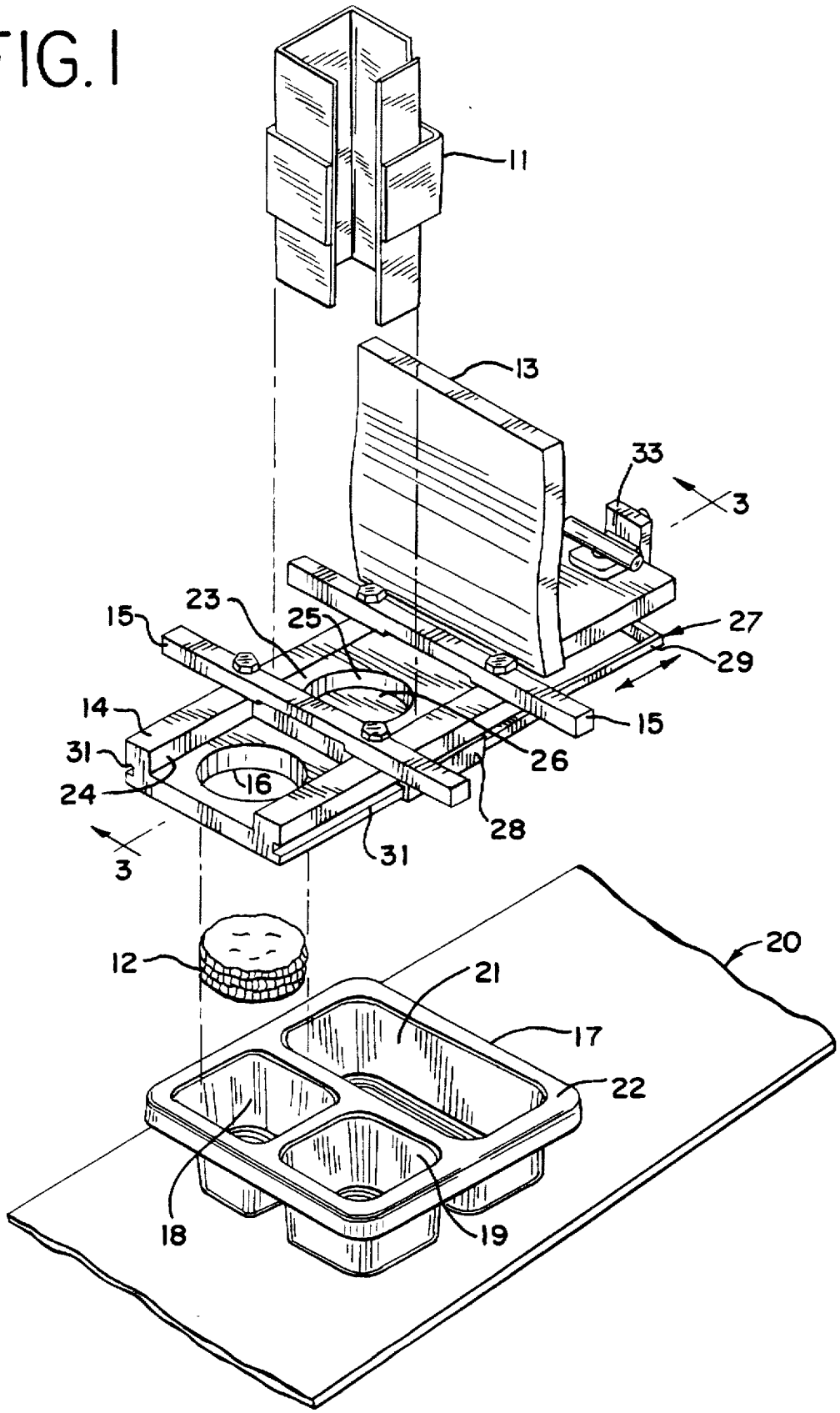
FIG. 1 is a perspective, partially exploded view of a preferred embodiment of the automatic placer according to the invention.
Figure 2:
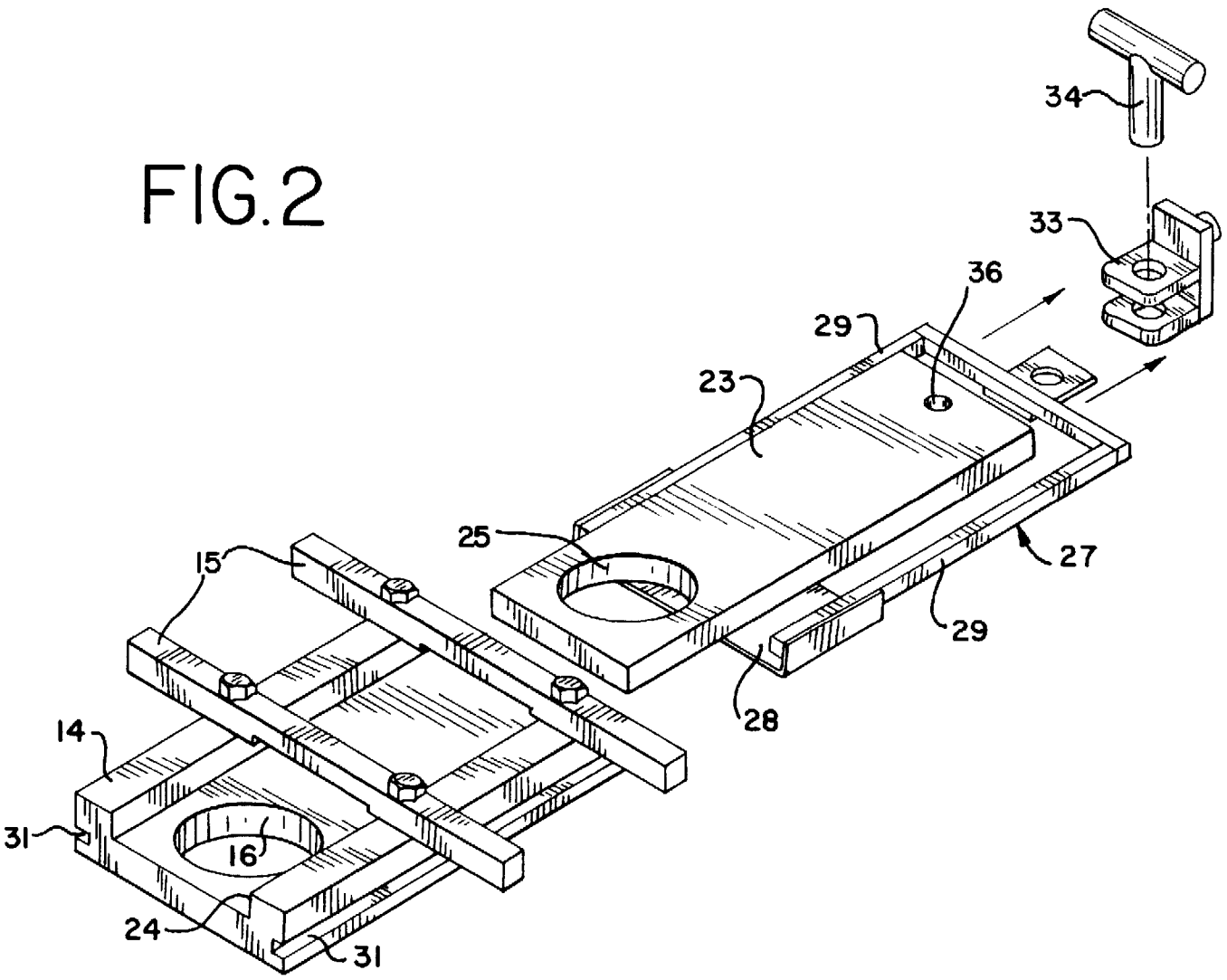
FIG. 2 is an exploded perspective view of selected portions of the placer shown in FIG. 1.

A cracker placer in accordance with the present invention is illustrated in FIG. 1. A chute 11 is shown. This chute holds a stack of a plurality of items to be filled in accordance with the present invention. The invention is especially advantageous when these items are thin and lightweight. Particular advantages are obtained when the products are also somewhat fragile, such as can be the case for many thin and lightweight baked products. In the illustrated embodiment, the products are crackers 12. Products having round perimeters, such as those which are illustrated, have been found to be especially well-suited for placement enhancement in accordance with the present invention.

It will be appreciated that the device illustrated in FIG. 1 typically will be a dispensing station component or fixture of larger material-handling equipment. Illustrative of equipment in this regard are placer systems available from Campbell-Hardage, Inc. A typical system of this type will have four such dispensing stations. A main cross-member 13 of such equipment can be seen in FIG. 1. Supported along this main cross member are a plurality of stationary blocks, one of such being shown in the drawings as guide block 14. Each guide block functions as a pusher guide block and is securely mounted by suitable means such as the illustrated pusher guide mounting bars 15. A preferred pusher guide block will be made of a lubricious and tough polymeric material such as Delryn®.

Guide block 14 includes a receptor or accumulator opening 16 which passes completely through the guide block. The material handling equipment also includes a conveyor system, generally shown at 20, which moves a series of trays 17 or other suitable packaging components so that same index in a desired manner with respect to the placer station as generally illustrated.

Figure 5:
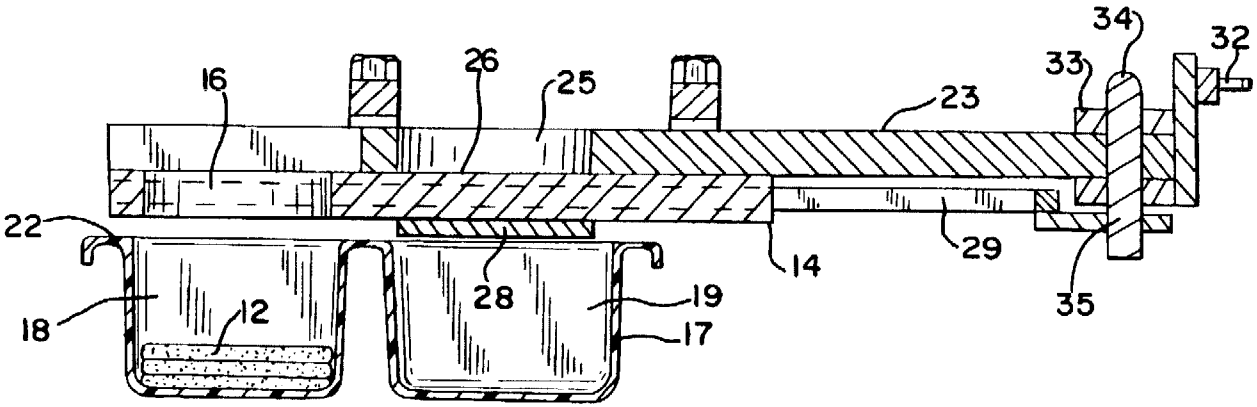
FIG. 5 is a cross-sectional view of the device illustrating a subsequent operation after baked products have been deposited into a compartment of a packaging tray.

More specifically, the conveyor system 20 of the material-handling equipment is capable of indexing each tray 17 so that it, or a selected compartment thereof, is in alignment with the accumulator opening 16 of the guide block 14. In the embodiment as shown in FIG. 1, a tray 17 is shown indexed for receiving crackers 12 from the illustrated placer. In this illustration, a particular compartment 18 of the tray is positioned in coaxial alignment with the accumulator opening 16 of the guide block component of the illustrated placer. It will be appreciated that, for clarity purposes, the tray 17 and conveyor system 20 shown in FIG. 1 is illustrated in an exploded manner with respect to the placer equipment; that is, in actual operation, each tray 17 will be much more closely spaced from the bottom of the guide block 14. This spacing is generally illustrated in FIG. 5.

Once filled with crackers 12, each tray 17 can be removed through the front of the material-handling equipment by operation of the conveyor system 20. In the filling operation which is illustrated as a preferred embodiment, each tray includes other compartments 19 and 21. It will be appreciated that a greater number or a lesser number of compartments can be included in each tray. When such additional compartments 19, 21 and the like are included, they will typically be filled with other items. The illustrated embodiment contemplates that the other compartments will include meal components and/or accessories. The compartments can be of any desired shape, depending upon the particular needs. For example, the compartments could be round in cross-section, or have a cross-section that is rectangular or square as illustrated in FIG. 1. It will be appreciated that other shapes can be used as needed. In this regard, compartment 18 for receiving the crackers 12 or the like will have a shape and size as illustrated such that same is generally close-fitting with respect to the crackers or the like which are placed therewithin. Typically, the sizing is such that at least a portion of the cracker stack, preferably at least a portion of each cracker of the stack, engages one or more portions of the sidewall of the compartment 18.

It will be appreciated that, after filling of the tray has been completed, a sheeting (not shown) will be sealed onto the flange 22 of the tray 17 in order to form a cover in a manner which is generally known in order to thereby hermetically seal each compartment from the other compartments. Thus, in addition to crackers or the like in compartment 18, one of the compartments could contain a meat product, another could contain a cheese product, and another could contain a dessert product. To the extent desired, each item thus sealed within the tray will be separately packaged yet within the same commercial product.

The illustrated placer apparatus also includes a pusher 23. In the illustrated embodiment, this pusher is slidably mounted within a trough 24 of the guide block. Preferably, the pusher is made of a material which is easily and thoroughly cleaned so as to be suitable for food use, while also providing an advantageous sliding interface with the guide block 14. A suitable material is Ertalyte®, a polymer harder than and compatible with Delryn®.

Figure 3:
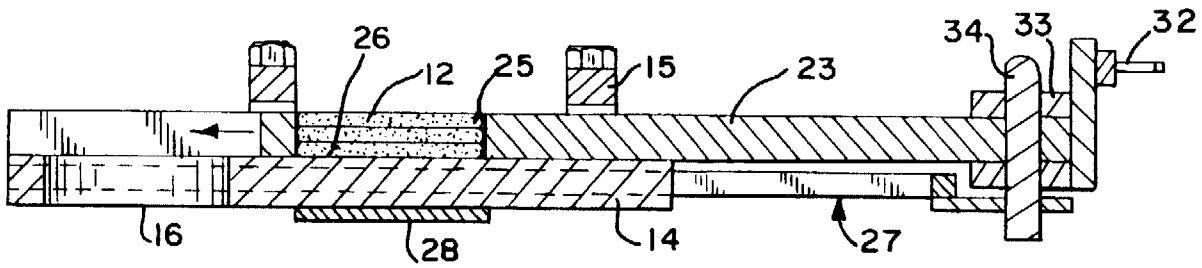
FIG. 3 is a cross-sectional view along the line 3—3 of FIG. 1, shown with three baked components having been received therewithin.

Pusher 23 includes a transfer opening 25 therethrough. By a suitable mechanism, the pusher is moved, typically between two positions. A receptor position of the pusher 23 is shown in FIGS. 1, 3 and 5. In it, the transfer opening 25 is positioned below the chute 11. As illustrated, the longitudinal axis of the transfer opening 25 is coaxial with a line running through the center of each cracker or the like 12 to the extent that they are positioned within a vertical stack within the chute 11. Thus, when the pusher is at this receptor position, one or more of the crackers or the like will fall into the transfer opening 25 but not pass therethrough. The cracker(s) or the like will be resting upon a portion of the upper surface 26 of the guide block 14. In the preferred arrangement which is illustrated, a plurality of the crackers or the like are accommodated by the depth of the volume defined by the sidewalls of the transfer opening 25 and the surface portion 26.

Figure 4:
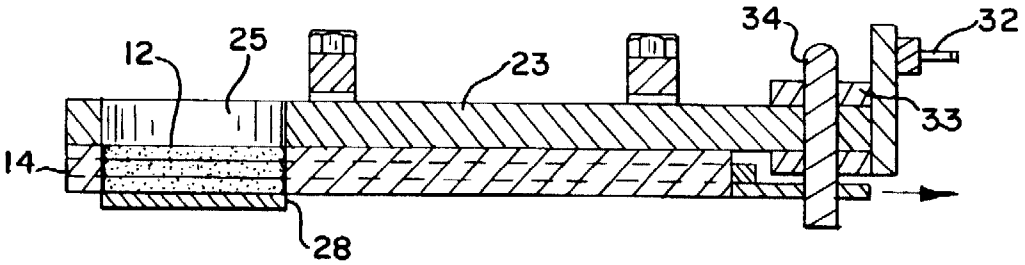
FIG. 4 is a cross-sectional view in accordance with FIG. 3, illustrating a subsequent stage of the operation of the device.

Another at-rest position of the pusher 23 is the transfer position, which is illustrated in FIG. 4. When at this transfer position, the transfer opening 25 of the pusher and the accumulator opening 16 of the guide block 14 are in substantial coaxial alignment with each other, as is illustrated in FIG. 4. At this position, the cracker(s) or the like fall into the accumulator opening 16. It has been determined in accordance with the present invention that this transfer of cracker(s) and the like from the transfer opening 25 and into the accumulator opening 16 develops kinetic energy within the cracker(s). It has been observed that, when the cracker(s) are allowed to fall directly into the compartment 18 of the tray, the kinetic energy which is manifested in movement and/or vibration of the cracker(s), most notably as a horizontal component of velocity, significantly impairs the reliability and repeatability of this placing operation.

If this horizontal velocity component is not checked, the device has a reliability or repeatability rating of only 80% to 85%. That is, without the features of the invention, typically between 15% and 20% of the packages will have damaged or otherwise unsatisfactory stacks of crackers. When the horizontal velocity component is dissipated or absorbed such as by implementing the invention as illustrated herein, this reliability or repeatability rating is virtually perfect, the rating having been quantified at 99.9% repeatability. Thus, with the invention, virtually every package has an undamaged and properly stacked count of crackers.

In accordance with the present invention, a system is provided whereby the horizontal component of the velocity developed during the transfer into the accumulator opening 16 is arrested as noted. In the illustrated embodiment, this function is accomplished by providing an escapement mechanism or assembly generally designated at 27. This escapement assembly operates as a gate for the accumulator opening 16. In this regard, a gate or engagement member 28 is located at a working end portion of the escapement mechanism 27. In the illustrated embodiment, the gate or engagement member takes the form of a pan. The gate, engagement member or pan 28 prevents passage of the cracker(s) out of the accumulator opening 16. Specifically, this pan or the like provides a surface which is engaged by the bottommost baked product or cracker in the accumulator opening 16. It has been found that, when this engagement occurs, for even the briefest of time periods, the horizontal velocity components of the cracker or stack of crackers are absorbed, the crackers cease moving or vibrating, and they are stabilized in their attitude and position.

With further reference to the illustrated escapement mechanism 27, this component of the embodiment as illustrated has slidable properties such that the gate, pan or engagement member 28 slides between an engaged position (FIG. 4) and a clear position (FIGS. 1, 3 and 5). The illustrated embodiment includes a pair of rails 29 slidably mounted within slots 31 of the guide block 14. With this arrangement, lateral and typically horizontal sliding is accomplished such that the escapement mechanism 27 moves along a plane perpendicular to the axis of the accumulator opening 16.

Referring more particularly to the operation of the escapement mechanism 27, its preferred lateral sliding movement is rapid and avoids any substantial disruption of the cracker (s) during movement from its engaged position to its clear position. This avoids disruption of the cracker(s) which had just been stabilized by the engagement between the cracker (s) and the engagement member 28. In this manner, the cracker(s) will drop directly into the package compartment 18 without such dropping being disrupted by any horizontal velocity components of these cracker(s).

The escapement mechanism can be moved in any convenient manner. In the illustrated arrangement, a rod 32 of an air cylinder or the like is secured to a clevis 33 of an attachment assembly. Also included in the attachment assembly is a pin 34 which joins the clevis 33 to the escapement mechanism, such as through a hole 35 at the control end of the escapement mechanism. It will be appreciated that extension of the rod 32 of the air cylinder moves the escapement mechanism from the clear position to the engaged position, while contraction of the rod 32 moves the escapement mechanism from the engaged position to the clear position.

In an arrangement which is convenient from a construction point of view and which has functional advantages as well, the rod 32 also passes through a hole 36 at the control end portion of the pusher 23. When this aspect of the attachment assembly is provided, the pusher 23 and the escapement mechanism 27 slide in sequence. In a preferred arrangement that is illustrated, the pan 28 is thus always below and in general alignment with the transfer opening 25 of the pusher 23. This insures that the pan 28 closes off the accumulator opening 16 of the guide block at the time that the cracker(s) fall from the transfer opening 25 and into the accumulator cavity that is thus formed by the accumulator opening 16 and the pan 28.

Referring now more particularly to the operation or process associated with the illustrated equipment, a stack of crackers or the like is initially positioned within the chute 11. In the FIG. 3 illustration, it will be noted that three crackers fall from the chute 11 and into the transfer opening 25 in order to form a sub-stack of crackers. It has been found that, with a typical cracker, placing three crackers at time is a viable approach. Baked products, even including relatively uniform items such as crackers, will vary in thickness somewhat. It has been found that, if greater than three typical crackers are handled at one time, variation in cracker thicknesses can lead to a situation where, at times, proper movement of the cracker sub-stack is impeded. For example, if one or more of the crackers in a particular sub-stack which is arranged for movement through the equipment according to the invention have thicknesses which are greater than a given norm, the sub-stack, in some instances, will have a height greater than that of the accumulator opening and/or of the transfer opening. Such excess height would result in hang-up of the equipment or, more likely, damage to one or more of the crackers in the sub-stack.

Next, the pusher is moved to the left as shown by the arrow in FIG. 3 until its transfer opening is in alignment with the accumulator opening of the guide block. By that time, the engagement member, gate or pan of the escapement mechanism has been positioned immediately below the accumulator opening of the guide block to prevent passage of the cracker sub-stack through this accumulator opening. In addition, the cracker sub-stack immediately is engaged by the pan or the like of the escapement mechanism to dampen the horizontal velocity components of the cracker sub-stack. This engagement is preferably for only a very short time. It is in nature of a "touch" which is all that is required in order to arrest movement and vibration of the cracker sub-stack before it drops into the package. A typical engagement time in this regard is between about 150 to about 200 milliseconds, generally not more than about one quarter of a second. It will be appreciated that this movement of the pan from its clear position to its engaged position and back to its clear position is preferably a generally horizontal movement as shown.

Once the escapement gate assembly moves away and clears the accumulator opening of the guide block, the illustrated sub-stack of crackers falls into a desired compartment of a tray as illustrated in FIG. 5. Without the illustrated operation of the device according to the invention, this cracker sub-stack would have velocity components which can cause them to mis-align within the compartment of the tray. In the illustrated embodiment, the pan arrests these velocity components during the small fraction of a second that it engages the cracker sub-stack.

In a typical operation, the tray will remain at the position illustrated in FIG. 5 while the device moves through another cycle in order to thereby deposit another sub-stack of crackers into the compartment of the tray and on top of the sub-stack of crackers already within the package compartment. This follow-up filling can be omitted or repeated as needed until the desired number of crackers or the like are positioned within the compartment, tray or package.

It will be understood that the embodiments of the present invention which have been described are illustrative of some of the applications of the principles of the invention. Numerous modifications may be made by those skilled in the art without departing from the true spirit and scope of the invention.

We claim:

1. An apparatus for automatically dispensing thin and lightweight baked products from a stack of such products and for placing same into a close-fitting compartment of a packaging tray, comprising:

an assembly for presenting to a designated location at least one at a time of a series of packaging trays, each tray having at least one compartment which is sized and shaped so as to closely accommodate therewithin a plurality of thin and lightweight baked products;

a guide block positioned above the designated location, said guide block having an accumulator opening therethrough, said accumulator opening being in substantial coaxial alignment with the compartment of the tray at the designated location;

a support member for supporting a stack of the thin and lightweight baked products at an entry location which is above said guide block, said entry location being spaced laterally from the accumulator opening of the guide block;

a pusher having a transfer opening therethrough, said pusher being laterally movable such that its said transfer opening moves between at least two positions, one such position being a receptor position and another such position being a transfer position, said transfer opening being in general coaxial alignment with said entry location when the pusher is at said receptor position, and said transfer opening being in general coaxial alignment with said accumulator opening of the guide block when the pusher member is at said transfer position; and an escapement gate assembly having an engagement member, said engagement member being moveable between an engaged position and a clear position, said engaged position being one at which said engagement member is below said accumulator opening of the guide block to prevent passage of the thin and lightweight baked products out of said accumulator opening of the guide block, and said clear position being one at which said engagement member has moved away from said accumulator opening to permit thin and lightweight baked products within said accumulator opening of the guide block to fall into the compartment of the packaging tray at the designated location.

2. The apparatus in accordance with claim 1, wherein said engagement member is a gate which extends substantially across the accumulator opening when the engagement member is at the engaged position.

3. The apparatus in accordance with claim 1, wherein said engagement member is a pan which substantially closes the accumulator opening when the engagement member is at the engaged position.

4. The apparatus in accordance with claim 1, wherein said engagement member slides along a generally horizontal plane when moving between the engaged position and the clear position.

5. The apparatus in accordance with claim 4, wherein said engagement member is a pan which substantially closes the accumulator opening when the engagement member is at the engaged position.

6. The apparatus in accordance with claim 1, further including an attachment assembly which operatively joins the pusher and the escapement gate assembly whereby the pusher and the escapement gate assembly move simultaneously between their respective positions.

7. The apparatus in accordance with claim 6, wherein said pusher member and said engagement member move along respective generally horizontal planes.

8. The apparatus in accordance with claim 1, wherein said guide block is stationary and said pusher and said engagement member slidably move with respect to said guide block.

9. The apparatus in accordance with claim 1, wherein each of said accumulator opening of the guide block and said transfer opening of the pusher have a depth which accommodates a plurality of the thin and lightweight products.

10. An apparatus for automatically dispensing a sub-stack of crackers from a primary stack of crackers and for placing the sub-stack into a compartment of a packaging tray, comprising:

a conveyor assembly for presenting to a designated location a series of packaging trays each having at least one compartment sized and shaped to accommodate a plurality of crackers;

a guide block positioned above the designated location, said guide block having an accumulator opening therethrough, said accumulator opening being in cracker-transferring alignment with the compartment of the tray when the tray is at the designated location;

a chute for supporting the primary stack of crackers, said chute being spaced laterally from the accumulator opening of the guide block;

a pusher having a transfer opening therethrough, said pusher being generally horizontally slidable such that its transfer opening slides between a receptor position and a transfer position, said transfer opening being in general coaxial alignment with said chute when the pusher is at said receptor position, and said transfer opening being in general coaxial alignment with said accumulator opening of the guide block when the pusher member is at said transfer position; and an escapement gate assembly having a gate member, said escapement gate assembly slidably moving said gate member between an engaged position and a clear position, said engaged position being one at which said engagement member is below said accumulator opening of the guide block to prevent passage of the sub-stack of crackers out of said accumulator opening of the guide block, and said clear position being one at which said gate member has moved away from said accumulator opening to permit the sub-stack of crackers within said accumulator opening to fall into the compartment of the packaging tray at the designated location.

11. The cracker placement apparatus in accordance with claim 10, wherein said engagement member is a pan which substantially closes the accumulator opening when the gate member is at the engaged position.

12. The cracker placement apparatus in accordance with claim 10, wherein said engagement member slides along a generally horizontal plane when the gate member moves between the engaged position and the clear position.

13. The cracker placement apparatus in accordance with claim 12, wherein said engagement member is a pan which substantially closes the accumulator opening when the gate member is at the engaged position.

14. The cracker placement apparatus in accordance with claim 10, further including an attachment assembly which operatively joins the pusher and the escapement gate assembly whereby the pusher and the escapement gate assembly move simultaneously between their respective positions.

15. The cracker placement apparatus in accordance with claim 10, wherein said guide block is stationary and said pusher and said engagement member slidably move with respect to said guide block.

16. A method for automatically dispensing thin and lightweight baked products from a stack of such products and for placing same into a compartment of a packaging tray, comprising the steps of:

presenting a series of packaging trays one at a time at a designated location, each said packaging tray having at least one compartment which is sized and shaped so as to accommodate therewithin a plurality of the thin and lightweight baked products;

providing a stack of the thin and lightweight baked products at a location generally above said designated location;

dropping at least one of said thin and lightweight baked products from said stack into a transfer opening of a pusher;

sliding the pusher and the thin and lightweight baked product within its transfer opening to a location spaced above the compartment of the packaging tray at said designated location;

thereafter permitting the thin and lightweight baked product within the transfer opening to fall within an accumulator opening of a guide block, said accumulator opening being directly above the compartment of the tray at said designated location;

engaging the thin and lightweight baked product with an escapement gate assembly when said product initially enters the accumulator opening during said permitting step and simultaneously dissipating substantially all horizontal components of velocity imparted during said sliding and permitting steps to the thin and lightweight baked product by engagement of the thin and lightweight product;

clearing the bottom end of the accumulator opening by moving the escapement gate assembly; and passing said thin and lightweight baked product into the compartment of the packaging tray, said passing step being in the absence of any substantial horizontal components of velocity associated with the thin and lightweight product.

17. The method in accordance with claim 16, wherein said thin and lightweight products are crackers.

18. The method in accordance with claim 16, wherein a plurality of the thin and lightweight products are transferred during said dropping step to form a sub-stack of products, and said sub-stack is transferred during said sliding, permitting and passing steps.

19. The method in accordance with claim 18, wherein said dropping, sliding, permitting, engaging, and clearing steps are repeated with respect to a further sub-stack of products, and wherein a further passing step passes said further sub-stack into the compartment and on top of the sub-stack transferred therewithin during the prior said passing step.

* * * * *

UNITED STATES PATENT AND TRADEMARK OFFICE

CERTIFICATE OF CORRECTION

PATENT NO. : 5,752,366

DATED : May 19, 1998

INVENTOR(S) : Matt D. Wilfong, Peter V. Doll and Gregory J. Risse

It is certified that error appears in the above-identified patent and that said Letters Patent is hereby corrected as shown below:

On the Cover Page, in the ABSTRACT, line 4, "falls into a" should read --falls into an--.

Col. 2, line 36, "It accordingly" should read --It is accordingly--.

Col. 5, lines 52-53, "cracker (s)" should appear as --cracker(s)--; lines 55-56, "cracker (s)" should appear as --cracker(s)--.

Col. 6, line 23, "crackers at time" should read --crackers at a time--.

Signed and Sealed this

Twenty-seventh Day of June, 2000

*Attest:*

Q. TODD DICKINSON

*Attesting Officer*

*Director of Patents and Trademarks*